US009636740B1

(12) United States Patent
Nikkel

(10) Patent No.: US 9,636,740 B1
(45) Date of Patent: May 2, 2017

(54) MICRO-STOP FOOT AND PUNCH SET

(71) Applicant: Robert E. Nikkel, Fort Collins, CO (US)

(72) Inventor: Robert E. Nikkel, Fort Collins, CO (US)

( * ) Notice: Subject to any disclaimer, the term of this patent is extended or adjusted under 35 U.S.C. 154(b) by 350 days.

(21) Appl. No.: 14/322,851

(22) Filed: Jul. 2, 2014

(51) Int. Cl.
*B23Q 7/14* (2006.01)
*B21J 15/50* (2006.01)

(52) U.S. Cl.
CPC ..... *B21J 15/50* (2013.01)

(58) Field of Classification Search
CPC ..... B23P 11/005; B23P 15/02; B23P 15/28; B23P 15/36; B23Q 1/008
See application file for complete search history.

(56) References Cited

U.S. PATENT DOCUMENTS 5,367,759 A * 11/1994 Loew ..... B21D 39/06 285/222
5,535,506 A * 7/1996 Chalfin ..... A41H 37/00 269/7
5,713,116 A * 2/1998 Nickerson ..... B23P 19/062 29/243.518
6,360,415 B1 * 3/2002 Wada ..... B21D 41/02 29/281.1
6,421,900 B1 * 7/2002 Hunt ..... B21J 15/10 269/3
8,769,790 B2 * 7/2014 Kernosky ..... B21J 15/025 29/243.5
9,205,520 B2 * 12/2015 Cooke ..... B23P 19/062

* cited by examiner

*Primary Examiner* — Lee D Wilson

(57) ABSTRACT

Punch foot and micro-stop foot for use in removing rivets from joined work pieces. Blades in the punch foot create indentations in a rivet head, and blades in the micro-stop foot engage the indentations in the rivet head to prevent the rivet from spinning during the removal process.

8 Claims, 4 Drawing Sheets

MICRO-STOP FOOT AND PUNCH SET

FIELD OF THE INVENTION

The present invention relates generally to an apparatus and method for removing blind rivets and blind bolts from joined work pieces held together by these types of fasteners.

BACKGROUND OF THE INVENTION

During maintenance of aircraft and other industrial equipment, it is often necessary to remove previously installed blind rivets, blind bolts, and similar fasteners. This is generally a difficult, multi-step process. All rivets and similar rivet-like fasteners have, at a minimum, a sleeve, or rivet body, and a stem which upsets the blind side of the sleeve when the stem is pulled with sufficient force during installation, so the rivet holds at least two work pieces together. Removal of a rivet involves drilling though one or more parts of the rivet. Aerospace fasteners are more sophisticated and usually include locking rings or other locking devices that add further difficulty to the rivet removal process. Aluminum rivets are fairly easy to drill into and remove, but aerospace fasteners currently in use are made of alloy metals, stainless steel, Monel®, Inconel®, and the like, which are extremely difficult to remove after being initially installed. These alloy steel fasteners are difficult to drill, and those with locking rings that hold the rivet stems in place once they have been upset (pulled) by the installation tool are harder still to drill, in addition to adding at least one extra drilling step for removal.

Rivet removal involves a number of steps, and there are about as many techniques for fastener removal as there are artisans doing them. It has never been an easy process. The two leading fastener manufacturers, Cherry Aerospace and Huck (Alcoa Fastening Systems) each have a process manual for fastener removal, and Huck even produces tooling for rivet removal. However, no process in use until now has been fool proof. An example of a rivet removal process is taken from instructions provided at www.alcoa-.com. As illustrated in FIG. 1, a rivet has a sleeve 10 with a head 12 and a locking ring 14 (the first feature below the top surface of the rivet head 12), and a stem 16, joining work pieces 18 and 20. With the stem 16 in place, the rivet is, by design, doing what it is supposed to do, holding work pieces together.

- Step 1, FIG. 1*a*: A small center drill bit 22 is used to provide a guide for a larger drill.
- Step 2, FIG. 1*b*: A high strength drill bit 24 of a diameter equal to the diameter of rivet stem 16 is used to drill to depth of locking ring 14. If there is a locking ring or collar in place, such as locking ring 14, it must be drilled out so the stem 16 is free to be punched out of the rivet sleeve 10 in step 2.
- Step 3, FIG. 1*c*: A steel drift pin 26 of proper size is used to drive out the rivet stem 16.
- Step 4, FIG. 1*d*: A drill bit 28 having the same diameter as the outer diameter of rivet sleeve 10 is used to drill nearly through the rivet head 12.
- Step 5, FIG. 1*e*: A drift pin 30 is used as a pry to break off rivet head 12.
- Step 6, FIG. 1*f*: A drift pin 32 having the same outer diameter as the rivet sleeve 10 is used to drive the sleeve out.

Most rivets are designed to clamp together the two work pieces they are installed into, but they may not be designed to fully fill the holes they are installed through and may not have good "hole fill" characteristics. This is particularly true for rivets used in composite structures in both aircraft and industrial applications. Some rivets are designed to both clamp the work pieces together and fill the hole at the same time; they have both "clamp up" and "hole fill" characteristics. Thus, if the rivet is of the "clamp up" design only, which most are, the sleeve is easily caused to spin when drilled during steps 1 and 2, and especially in step 4 after the stem is removed, due to the partial release of the "clamp up" force with removal of the stem. A drill bit turns in a clockwise direction and causes the rivet sleeve to rotate in the same direction if the torque applied to the rivet sleeve by the drill exceeds the "clamp up" force that was established when the rivet was installed into the work pieces. Therefore, the problem is most severe with rivets that clamp the pieces together without "hole fill" capability, but also encountered with rivets that do have "hole fill" characteristics. Wire draw rivets have sleeves that are designed expand and fill the hole during installation. So, it is simply a matter of physics: if the torque load of the drill bit during the rivet removal process exceeds the applied "clamp up" and "hole fill" forces of the installed fastener, the rivet sleeve will spin. If a rivet spins during the removal process, it can damage the work piece or airframe component and become nearly impossible to remove other than by grinding off the rivet head. Grinding metal alloy rivets can easily damage the work piece if the artisan is not careful. In the case of a composite airframe component, the heat buildup from grinding will indeed damage the resins in the composite material, which will require complete replacement of the component, a process that is expensive and will require the removal of numerous other fasteners.

Thus, there is a need for a system and method for removing previously installed blind rivets and similar fasteners reliably and more simply than can be done with current tools and methods.

SUMMARY OF THE INVENTION

To achieve the foregoing and other objects and in accordance with the purpose of the present invention broadly described herein, one embodiment of this invention comprises an apparatus for use in removing blind rivets from work pieces, with the apparatus comprising means for preventing rivets from spinning while being drilled. The means for preventing may comprise a device selected from punch feet adapted for engagement with punches and having a configuration of first blades that self-center the punch foot over the head of an installed rivet and create indentations in the rivet head when force is applied to the blades via a punch; micro-stop feet adapted for engagement with micro-stops and having a configuration of second blades, the second blades engageable in a self-centered manner with indentations in the head of an installed rivet; and combinations thereof.

If the apparatus comprises a punch foot, the punch foot may include a cylindrical opening having a central axis and a diameter sized to fit around a rivet head with at least two of the first blades arranged within the opening in a radial array have cutting edges at an angle of about 45 degrees relative to the central axis. The punch foot may comprise means for partially surrounding the first blades. The means for partially surrounding may comprise a foot ring. The punch foot may also have an internally threaded opening for engagement with external screw threads of a punch.

If the apparatus comprises a micro-stop foot, the micro-stop foot may include a hole passing therethrough having a central axis and a width sized to accommodate a drill bit. The micro-stop foot may have a rivet head engaging portion comprising a plurality of second blades arranged in a radial array within a recess, with the array centered about the central axis and the second blades having edges engageable with radial indentations in a rivet head and adapted for centering the radial array over the rivet head. The micro-stop foot may comprise means for attachment to a micro-stop device. The second blades may have cutting edges at an angle of about 45 degrees relative to the central axis of the micro-stop foot. The micro-stop foot may also comprise a foot ring that surrounds the second blades. The means for attachment may include through holes for set screws.

The apparatus may comprise:

punch feet adapted for engagement with punches and having a configuration of first blades that self-center the punch foot over the head of an installed rivet and create indentations in the rivet head when force is applied to the blades via a punch; and a plurality of micro-stop feet adapted for engagement with micro-stops and having a configuration of second blades, the second blades engageable in a self-centered manner with indentations in the head of an installed rivet.

Another embodiment of the present invention comprises a method for removing a blind rivet joining a plurality of work pieces, with the rivet comprising a rivet head attached to a rivet sleeve with the rivet sleeve surrounding a rivet stem. The method comprises the steps of:

a) obtaining a punch foot assembled with a punch, the punch foot having a round opening with a central axis and a diameter sized to fit around a rivet head, the punch foot comprising at least two punch blades arranged within the opening in a radial array;
b) creating indentations in a rivet head by placing the punch foot over the rivet head and forcing the punch, punch foot, and blades against the rivet head, thereby creating a radial array of indentations in the rivet head;
c) obtaining a micro-stop and a micro-stop foot assembled with a drill and a drill bit sized for drilling through the rivet locking ring and wherein the micro-stop foot comprises a radial array of micro-stop blades, positioning the micro-stop foot over the rivet head with the first micro-stop foot blades engaging the rivet head via the indentations formed by the punch foot blades, and drilling a hole substantially through the rivet head;
d) breaking the rivet head off the rivet sleeve; and
e) removing the rivet sleeve from the work pieces.

Yet another embodiment of the present invention comprises a method for removing a blind rivet joining a plurality of work pieces, wherein the rivet comprises a rivet head attached to a rivet sleeve with the rivet sleeve surrounding a rivet stem having a locking ring in a position selected from adjacent the head of the rivet, around the stem of the rivet, between the rivet head and the work pieces, and combinations thereof. The method comprising the steps of:

a) obtaining a punch foot assembled with a punch, the punch foot having a round opening with a central axis and a diameter sized to fit around a rivet head, the punch foot comprising at least two punch blades arranged within the opening in a radial array;
b) creating indentations in a rivet head by placing the punch foot over the rivet head and forcing the punch, punch foot, and blades against the rivet head, thereby creating a radial array of indentations in the rivet head;
c) obtaining a first micro-stop and first micro-stop foot assembled with a drill and a drill bit sized for drilling through the rivet locking ring and wherein the first micro-stop foot comprises a radial array of first micro-stop blades, positioning the micro-stop foot over the rivet head with the first micro-stop foot blades engaging the rivet head via the indentations formed by the punch foot blades, and drilling a hole through the rivet head and the locking ring;
d) removing the rivet stem from the rivet sleeve
e) obtaining a second micro-stop assembled with a second micro-stop foot with a drill having a drill bit with a diameter substantially the same as the rivet sleeve diameter and wherein the second micro-stop foot comprises a radial array of second micro-stop blades, positioning the second micro-stop foot over the rivet head with the second micro-stop foot blades engaging the rivet head via the indentations formed by the punch foot blades, and drilling a hole substantially through the rivet head;
f) breaking the rivet head off the rivet sleeve; and
g) removing the rivet sleeve from the work pieces.

BRIEF DESCRIPTION OF THE DRAWINGS

These and other features, aspects, and advantages of the present invention will become better understood with reference to the following description, appended claims, and accompanying drawings, where:

DESCRIPTION OF THE PREFERRED EMBODIMENT

The current invention comprises a device and method for removing blind rivets and similar fasteners that have previously been installed into airframes and other industrial equipment, particularly when the rivets and fasteners are made from steel alloys. A key feature is the ability to prevent a rivet sleeve from spinning when being drilled by creating more friction in the anti-rotational direction to counter the drill bit friction going in the rotational direction. The user performing the work needs to apply no more than hand force while drilling into the fastener head during rivet removal.

To simplify the following discussion, the term "rivet" includes blind rivets and other similar fasteners.

In accordance with the present invention, a punch foot having blades configured concentrically around a central opening is used to form indentations in the rivet head. In addition, an anti-rotational device in the form of a micro-stop foot can be placed over the rivet head, with another set of blades engaging the indentations formed by the punch foot blades. Both the punch foot and the micro-stop foot can be held in position by a user's hand force, while a drill bit is inserted through a central opening in the micro-stop foot to drill into the rivet head.

Figure 1:
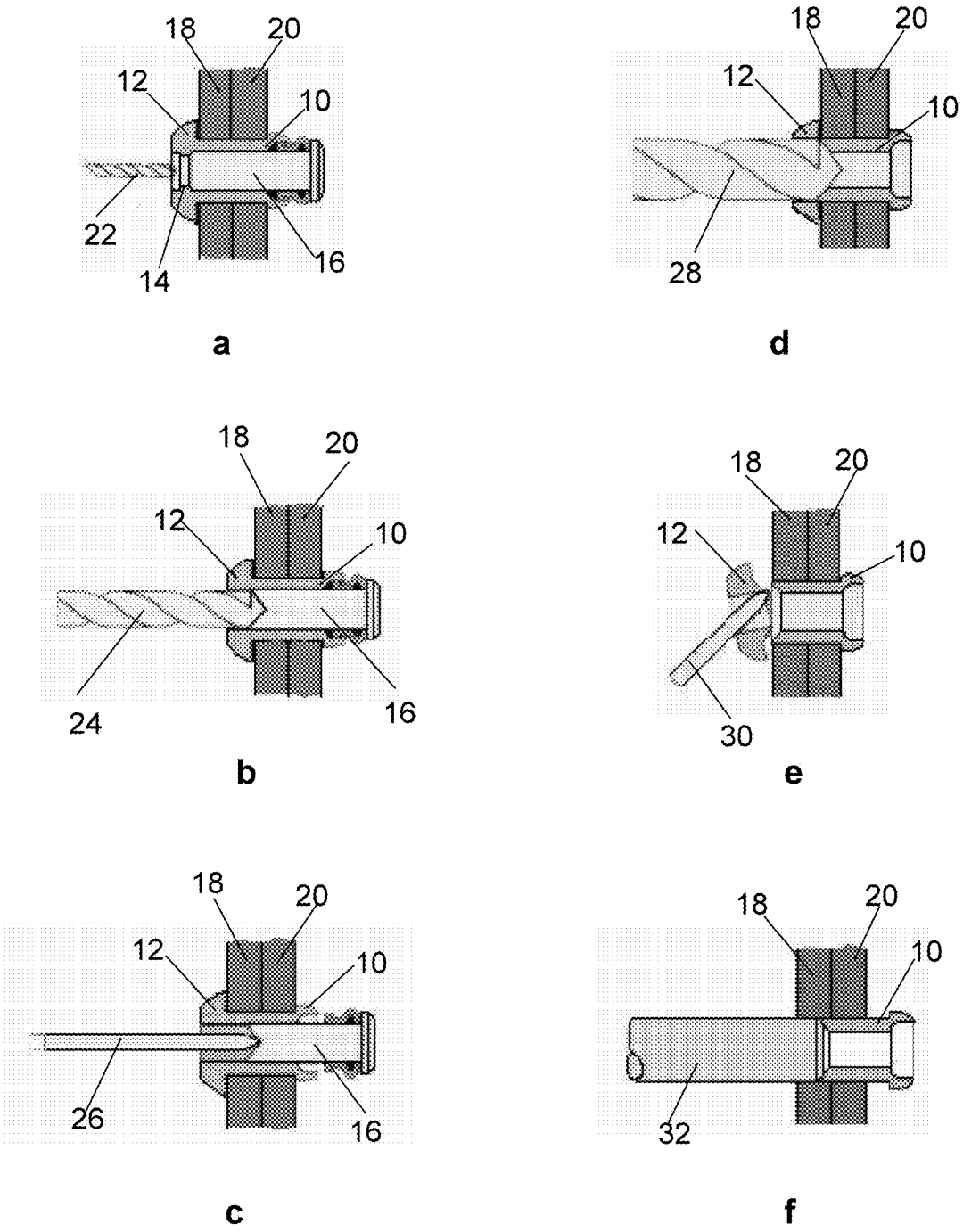
Fig. 1 Prior Art
FIGS. 1*a-f* illustrate a prior art process for removing an installed blind rivet.
Figure 2:
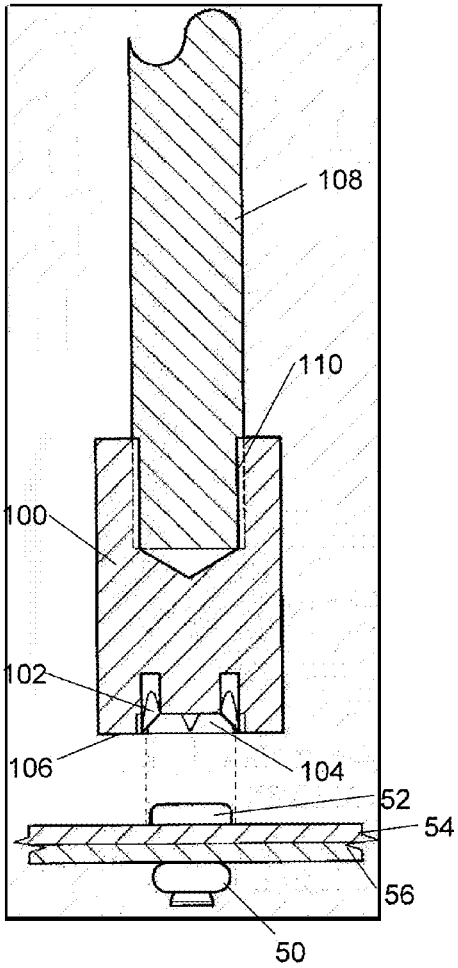
FIG. 2 is a cross sectional view of an embodiment of a punch foot in use with a punch in removing a rivet from joined work pieces in accordance with the present invention.

The apparatus and method for its use can be understood with reference to FIG. 2. A rivet 50 with head 52 joins work pieces 54 and 56. Punch foot 100 has blades 102 arranged concentrically within an opening 104 extending into end surface 106. To remove rivet 50, punch 108 is threaded into opening 110 of punch foot 100, and the punch foot 100 is positioned with opening 104 over rivet head 52 and blades 102 contacting the outer surface of rivet head 52. Punch foot 100 is held in place with one hand while the user uses a hammer on punch 108 to force blades 102 to make indentations in rivet head 52. The punch 108 and punch foot 100 are then removed, and a micro-stop foot 150, assembled with micro-stop device 152 is positioned over rivet head 52. Micro-stop foot 150 comprises blades 154 mounted concentrically around opening 156. The micro-stop foot 150 and micro-stop device 152 are rotated until the blades 154 engage the indentations previously formed in rivet head 52 using punch foot 100 and punch 108. With the user holding the micro-stop foot 150 in the indentations in rivet head 52 with one hand and operating a drill assembled with micro-stop device 152 and micro-stop foot 150 in the other hand, a hole is drilled into rivet head 52. The hole through the rivet head 52 using drill bit 158 is concentric with the rivet sleeve, due to the self-alignment of the micro-stop foot blades 154 in the indentations formed using punch foot 100 and punch 108.

Figure 3:
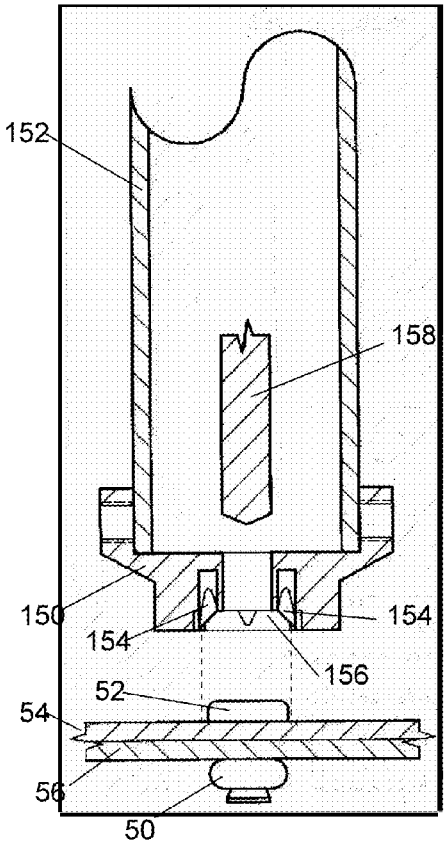
FIG. 3 is a cross sectional view of an embodiment of a micro-stop foot in use with a micro-stop and drill bit in removing the rivet from the joined work pieces of FIG. 2 in accordance with the present invention.

Thus, using the punch foot and micro-stop foot of the present invention, a rivet can be removed quickly and easily from joined work pieces by an unskilled user and without the rivet sleeve spinning within the work piece hole. A method for removing rivets may comprise the following steps:

1. Indentations are created in a rivet head by placing a self-centering punch foot assembled with a punch over the rivet head and using a hammer to force the punch, punch foot, and blades against the rivet head. The blades create indentations in the rivet head, arranged concentrically on the rivet head. The punch and punch foot are removed. (FIG. 2)
2. A first micro-stop and first self-centering micro-stop foot, assembled with a drill, are positioned over the rivet head, with blades in the micro-stop foot positioned in the indentations formed by the punch foot blades. (FIG. 3) While holding the first micro-stop foot with one hand and the drill with the other, a user drills into the rivet head to the depth of the rivet locking ring or collar. The first drill bit is substantially the same diameter as the outer diameter of the rivet stem and sized to drill through the locking ring or collar. The indentations formed in step 1 and the blades of the first micro-stop foot center the first micro-stop foot over the rivet head.
3. A drift pin or punch is used to drive out the rivet stem.
4. A second micro-stop and second self-centering micro-stop foot, assembled with a drill and a second drill bit sized to drill a hole having substantially the same diameter as the outer diameter of the rivet sleeve, are positioned with the blades of the second micro-stop foot positioned in the rivet head indentations formed with the punch foot blades. While holding the second micro-stop foot with one hand and the drill with the other, the user drills into the rivet head to drill almost through the rivet head. (FIG. 3)
5. A prying device is used to break off the rivet head.
6. A drift pin having the same outer diameter as the rivet sleeve is used to drive the sleeve out of the hole in the work pieces.

Thus, rivets can be removed quickly and reliably by an unskilled worker, without a significant risk of damage to the work pieces they join. The first micro-stop foot may be removed from the drill and replaced with the second micro-stop foot between steps 2 and 4. It may be desirable to have a first drill assembled with the first micro-stop foot and the first drill bit and a second drill assembled with the second micro-stop foot to facilitate rapid removal of a large number of rivets.

Figure 4:
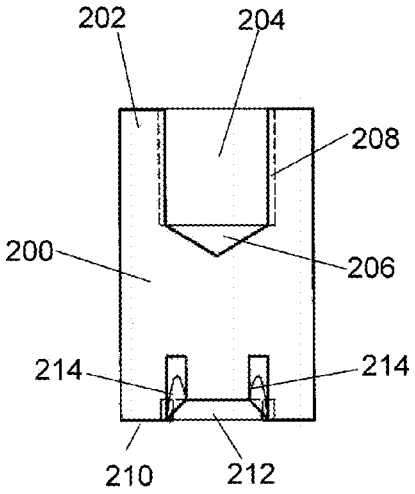
FIG. 4 is a cross sectional view of one embodiment of a punch foot in accordance with the present invention.

One embodiment of a punch foot 200 of the present invention is shown in FIG. 4. Punch foot 200 is formed from a right cylinder of a suitable material, such as a steel alloy. Proximal end 202 is drilled and tapped to form indentation 204, sized to accommodate a suitable punch (not shown). The punch is preferably secured to the punch foot, such as via screw threads 208. Second end 210 has a round opening 212 sized to fit around the head of an installed rivet. Blades 214 are mounted inside opening 212 in a concentric arrangement, positioned to engage and form indentations in the rivet head during use. Preferably the inner diameter of the circle which contacts the outer edges of the blades 214 is no smaller than the outer diameter of the head of the rivet to be removed, thus allowing the indentations formed by the blades to be used as discussed below to prevent the rivet sleeve from spinning while the rivet head is drilled.

Figure 6:
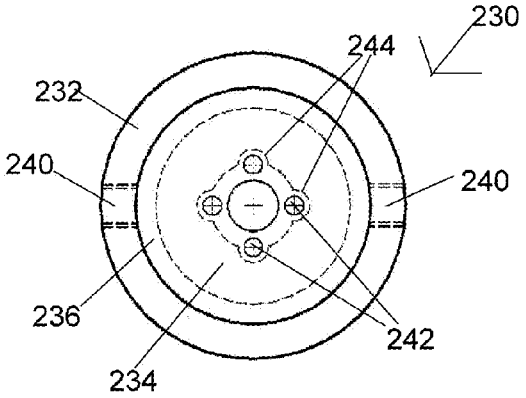
FIG. 6 is an end view of the micro-stop foot of FIG. 5.
Figure 5:
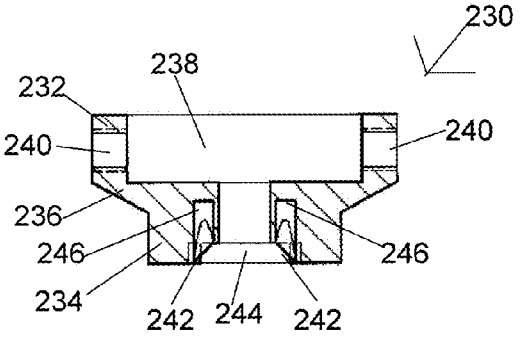
FIG. 5 is a cross sectional view of one embodiment of a micro-stop foot in accordance with the present invention.
Figure 7:
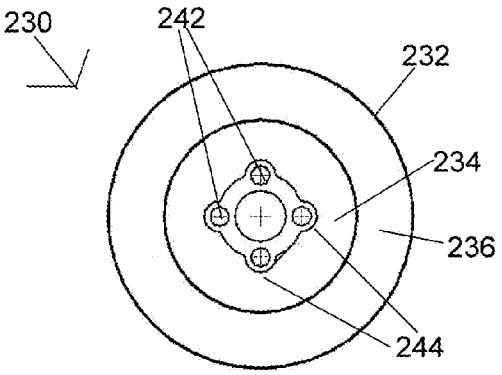
FIG. 7 is another end view the micro-stop foot of FIG. 5.

An embodiment of a micro-stop foot 230 of the present invention is shown in FIGS. 5-7. Micro-stop foot 230 comprises an outer wall having a larger outer-diameter cylindrical portion 232, a smaller outer-diameter cylindrical portion 234, and a truncated conical portion 236 between the cylindrical portions 232 and 234. Cylindrical portion 232 has an inner diameter (wall of recess 238) sized to accommodate a conventional micro-stop device (not shown). Cylindrical portion 234 and conical portion 236 have an inner diameter sized to provide a guide for centering a drill bit that has a diameter substantially the same as the outer diameter of the rivet sleeve. Cylindrical portion 234 also has a recess 244 into its end that is sized to fit around the head of a rivet to be removed. Threaded through holes 240 accommodate set screws for securing the micro-stop foot to the micro-stop device. Blades 242 are mounted into holes 246 in cylindrical portion 234, arranged concentrically around the central axis passing through the centers of cylindrical portions 232 and 234 and conical section 236. Blades 242 are also positioned to engage the indentations formed in the rivet head with punch foot 200.

Figure 8:
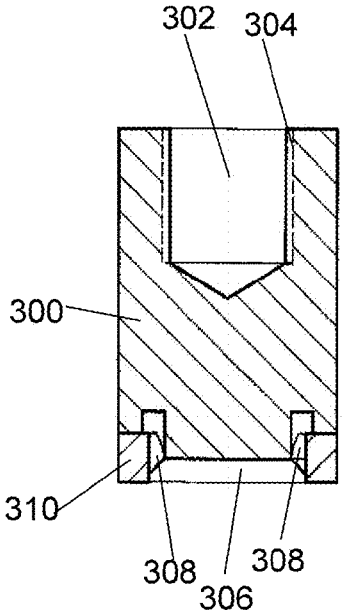
FIG. 8 is a cross sectional view of another embodiment of a punch foot in accordance with the present invention.

Another embodiment of a punch foot 300 of the present invention is shown in FIG. 8. Punch foot 300 comprises a right cylinder having a first central hollow 302 and a first inner diameter selected to accommodate a suitable punch, not shown. Screw threads 304 in opening 302 allow the punch to be attached securely to the punch foot 300. A second central hollow 306 is sized to fit closely over a selected size rivet head. Blades 308 are mounted into recesses in punch foot 300 in an arrangement that is concentric with the hollow 306 and positioned so that blades 308 make contact with a rivet head when punch foot 300 is in use. Foot ring 310 is mounted around blades 308 and extends past the tips of the blades, aiding in retaining and protecting the blades in punch foot 300 and protecting the user from inadvertent cuts when handling the punch foot.

Figure 10:
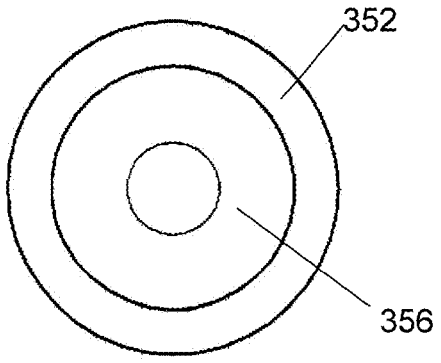
FIG. 10 is an end view of the micro-stop of FIG. 9.
Figure 9:
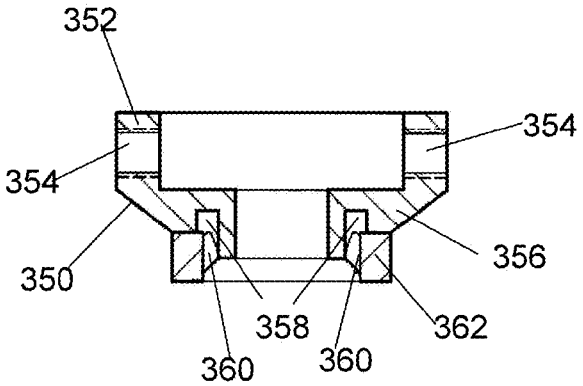
FIG. 9 is a cross sectional view of another embodiment of a micro-stop foot in accordance with the present invention.
Figure 11:
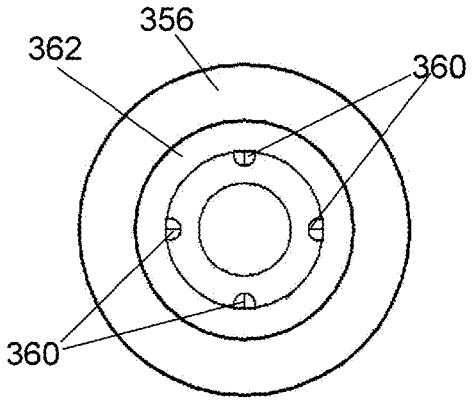
FIG. 11 is another end view of the micro-stop foot of FIG. 9.

An embodiment of a micro-stop foot 350 is shown in FIGS. 9-11. Micro-stop foot 350 comprises a hollow cylindrical portion 352 having an inner diameter selected to accommodate a suitable micro-stop (not shown). Threaded holes 354 pass through the cylindrical section to accommodate set screws (not shown) for mounting the micro-stop foot 350 onto the micro-stop. Truncated conical portion 356 includes a central hole sized to accommodate a drill bit (not shown) having a diameter suitable for drilling into a rivet head during use. Recessed holes 358 extend into conical portion 356 and position blades 360 in a radial concentric configuration. Foot ring 362 retains blades 360 inside recessed holes 358 and also protects the ends of blades 360 from damage and protects a user from inadvertent injury by the blades.

The blades of the punch foot and the micro-stop foot preferably have a cutting edge taper of about 45 degrees for optimal engagement and self-centering with rivet heads. The devices shown in FIGS. 2-11 have four blades, although any number of blades greater than one could be used.

The punch foot and micro-stop foot of the present invention allow rivets to be removed efficiently from work pieces without the rivets spinning inside the holes through the work pieces and without the need to grind the rivet heads for removal. Both feet can be held in place over a rivet head easily with one hand. Only hand force is required to maintain engagement of the micro-stop blades with the rivet head and prevent the rivet from spinning Both the punch foot and the micro-stop foot can be used easily and successfully by unskilled workers.

It may be desirable to provide a kit for rivets having specific head, sleeve, and lock ring diameters. The kit may comprise a punch foot sized for a particular diameter rivet head, a first micro-stop foot for use with a first micro-stop and first drill bit for drilling through the rivet heads and into rivet lock rings, and a second micro-stop foot for use with a second micro-stop and second drill bit for drilling into the rivet heads to facilitate removal of the rivet sleeves.

The foregoing description is considered as illustrative only of the principles of the invention. Further, since numerous modifications and changes will readily occur to those skilled in the art, it is not desired to limit the invention to the exact construction and process shown and described above. Accordingly, all suitable modifications and equivalents may be resorted to falling within the scope of the invention.

What is claimed is:

1. An apparatus for use in removing blind rivets from work pieces, said apparatus comprising means for preventing rivets from spinning while being drilled; wherein said means for preventing comprises a device selected from:

punch feet adapted for engagement with punches and having a configuration of first blades that self-center the punch foot over the head of an installed rivet and create indentations in the rivet head when force is applied to said blades via a punch;

micro-stop feet adapted for engagement with micro-stops and having a configuration of second blades, said second blades engageable in a self-centered manner with indentations in the head of an installed rivet; and combinations thereof; and a punch foot, wherein: said punch foot has a cylindrical opening having a central axis and a diameter sized to fit around a rivet head; said punch foot comprises at least two of said first blades arranged within the opening in a radial array have cutting edges at an angle of about 45 degrees relative to the central axis.

2. The punch foot of claim 1, comprising means for partially surrounding said first blades.

3. The punch foot of claim 2, wherein said means for partially surrounding comprises a foot ring.

4. The punch foot of claim 1, having an internally threaded opening for engagement with external screw threads of a punch.

5. The apparatus of claim 1, comprising a micro-stop foot, wherein: said micro-stop foot has a hole passing therethrough having a central axis and a width sized to accommodate a drill bit;

said micro-stop foot has a rivet head engaging portion comprising a plurality of second blades arranged in a radial array within a recess, said array centered about said central axis and said second blades having edges engageable with radial indentations in a rivet head, with said second blades adapted for centering said radial array over the rivet head; and said micro-stop foot comprises means for attachment to a micro-stop device.

6. The micro-stop foot of claim 4, wherein said second blades have cutting edges at an angle of about 45 degrees relative to the central axis of the micro-stop foot.

7. The micro-stop foot of claim 4, comprising a foot ring that surrounds said second blades.

8. The micro-stop foot of claim 4, wherein said means for attachment includes through holes for set screws.

* * * * *